US005752769A

United States Patent [19]

Weber et al.

[11] Patent Number: 5,752,769

[45] Date of Patent: May 19, 1998

[54] MORTAR MIXING MACHINE WITH TWO CONVEYING AND MIXING TUBES OF OPPOSITE CONVEYING DIRECTION

[75] Inventors: Hans Weber, Waldshut-Tiengen; Anton Müller, Kehlweg, both of Germany

[73] Assignee: INOTEC GmbH Transport- und Fördersysteme, Waldshut-Tiengen, Germany

[21] Appl. No.: 708,567

[22] Filed: Sep. 5, 1996

[30] Foreign Application Priority Data

Sep. 5, 1995 [DE] Germany ..... 295 14 183.3 U

[51] Int. Cl.[6] ..... B28C 5/14

[52] U.S. Cl. ..... 366/15; 366/50; 366/51

[58] Field of Search ..... 366/14, 15, 20, 366/33, 34, 35, 38, 50, 51, 64, 66, 67, 155.1, 156.1, 158.1, 168.1, 172.1, 186, 190, 194–196

[56] References Cited

U.S. PATENT DOCUMENTS

| | | | |
|---|---|---|---|
| 1,105,555 | 7/1914 | Farnham | 366/158.1 |
| 1,986,871 | 1/1935 | Withee | 366/15 |
| 2,104,191 | 1/1938 | Flynn | 366/15 |
| 2,487,533 | 11/1949 | Eastman | 366/158.1 X |
| 3,006,615 | 10/1961 | Mason, Jr. | 366/20 |
| 4,004,782 | 1/1977 | Jeppsen | 366/14 |
| 5,352,035 | 10/1994 | Macaulay et al. | 366/15 |

FOREIGN PATENT DOCUMENTS

| | | | |
|---|---|---|---|
| 0658409 | 6/1995 | European Pat. Off. . | |
| 1916351 | 10/1969 | Germany | 366/50 |
| 7005452 | 2/1970 | Germany . | |
| 1556686 | 3/1970 | Germany . | |
| 8704215 | 6/1987 | Germany . | |
| 3626313 | 2/1988 | Germany . | |
| 4119261 | 12/1992 | Germany | 366/35 |
| 2090761 | 7/1982 | United Kingdom | 366/20 |

*Primary Examiner*—Charles E. Cooley
*Attorney, Agent, or Firm*—Robert W. Becker & Associates

[57] ABSTRACT

A mortar mixing machine has a frame and a hopper supported by the frame for containing dry mortar. The hopper has an outlet with an outlet opening. A first conveying and mixing tube, connected in a working position thereof to the outlet so as to extend horizontally, has at least one water inlet and is designed for mixing the dry mortar fed into the conveying and mixing tube from the hopper with water introduced via the at least one water inlet to prepare mixed moist mortar. The first conveying and mixing tube has a removal opening for the mixed moist mortar remote from the outlet. A second conveying and mixing tube is connected to the frame for directly receiving in a working position thereof the mixed moist mortar. The second conveying and mixing tube conveys the mixed moist mortar in a direction opposite to the conveying direction of the first conveying and mixing tube. The second conveying and mixing tube has a drive and is slidably retractable into a rest position together with the drive.

7 Claims, 3 Drawing Sheets

MORTAR MIXING MACHINE WITH TWO CONVEYING AND MIXING TUBES OF OPPOSITE CONVEYING DIRECTION

BACKGROUND OF THE INVENTION

The present invention relates to a mortar mixing machine with especially funnel-shaped hopper for the dry mortar which is supported by a frame and which comprises an outlet. A conveying and mixing tube is connected to the outlet and comprises a water inlet as well as a removal opening for the mixed mortar at its forward end. The conveying and mixing tube is preferably horizontally arranged. A second conveying and mixing tube may be provided which is arranged so as to receive the mortar from the removal opening of the first conveying and mixing tube.

In a mortar mixing machine the dry mortar is mixed with water in order to prepare the required moist mortar mix.

A mortar mixing machine of the aforementioned kind is known from European Patent Application 0 658 409. It comprises a funnel-shaped hopper for the dry mortar. This hopper is secured to a frame. Its bottom portion is provided with a conveying device for the dry mortar having connected thereto a removal outlet. At the outlet opening of this removal outlet a conveying and mixing tube is detachably connected externally to the hopper. This conveying and mixing tube is provided at the beginning of the conveying path with a water inlet with which water supplied to the dry mortar so that the dry mortar is mixed therewith. At the forward end of the mixing tube the mixed moist mortar can be removed. Optionally, at the forward end of the first conveying and mixing tube a second conveying and mixing tube can be arranged which is vertically positioned so that the mixed moist mortar is subjected to a longer and more intensive mixing action with the mixing tools. The mixing intensity can thus be increased. Due to the vertical arrangement of this second conveying and mixing device, it is however required that the hopper have a certain minimal distance above the ground.

It is an object of the present invention to provide a mortar mixing machine with an improved arrangement of the second conveying and mixing tube.

SUMMARY OF THE INVENTION

The mortar mixing machine according to the present invention is primarily characterized by:

A frame;

A hopper, supported by the frame, for containing dry mortar;

The hopper having an outlet with an outlet opening;

A first conveying and mixing tube, connected in a working position thereof to the outlet so as to extend horizontally and having at least one water inlet, for mixing the dry mortar fed into the conveying and mixing tube from the hopper with water introduced via the at least one water inlet to prepare mixed mortar;

The first conveying and mixing tube having a removal opening for the mixed moist mortar remote from the outlet;

A second conveying and mixing tube connected to the frame for directly receiving in a working position thereof the mixed moist mortar;

The second conveying and mixing tube conveying the mixed moist mortar in a direction opposite to the conveying direction of the first conveying and mixing tube.

Preferably, the second conveying and mixing tube extends horizontally.

The second conveying and mixing tube expediently is separate from the first conveying and mixing tube and comprises a drive for effecting conveying and mixing.

Advantageously, the second conveying and mixing tube is positioned below the first conveying and mixing tube.

Advantageously, the second conveying and mixing tube comprises a supply funnel positioned below the removal opening of the first conveying and mixing tube.

In a prefer red embodiment of the present invention, the first and second conveying mixing tubes are removable from the working positions into a respective rest position.

The second conveying and mixing tube preferably comprises a drive and is slidably retractable into the rest position together with the drive.

The second conveying and mixing tube in the rest position is preferably positioned within the circumferential contour of the frame.

Advantageously, the second conveying and mixing tube comprises a carriage and wheels for retracting the second conveying and mixing tube into the rest position.

It is thus suggested with the present invention that the second conveying and mixing tube conveys the mixed moist mortar counter to the conveying direction of the first mixing and conveying tube and that it is preferably horizontally arranged.

This provides a mortar mixing machine with two conveying and mixing units with corresponding conveying pumps so that the produced mixed moist mortar, in contrast to processing in a single conveying and mixing tube, is substantially subjected to an intensive mixing with mixing tools over a travel path of twice the length. An optimal mixing intensity and thus an optimal wet mixed moist mortar quality can thus be achieved. In order to provide an optimal mixing action with the water introduced into the tube, the second conveying and mixing tube can be provided with a spiral pump. The mixed moist mortar is then introduced into a conveying line at the end of the second conveying and mixing tube. The advantage of the horizontal arrangement of the additional conveying and mixing tube is that the hopper can be designed such that it is positioned relatively close to the bottom since the second conveying and mixing tube does not require much space in the vertical direction.

In general, it is also possible to embody the first and second conveying and mixing tubes as a unit in the form of a horizontal U; however, in a preferred embodiment it is suggested that the second conveying and mixing tube be separate from the first conveying and mixing tube and provided with its separate drive for the conveying and mixing elements. This has the advantage that the two conveying and mixing tubes can be operated independent of one another. In a special embodiment, the additional conveying and mixing tube can be omitted for certain conditions. In any case, a specially arranged motor drives the conveying and mixing elements, especially the spiral pump in the second conveying and mixing tube.

In another embodiment it is suggested that the second conveying and mixing tube is positioned below the first conveying and mixing tube. This allows for optimal use of space because below the first conveying and mixing tube, and thus below the hopper, there is, in general, sufficient space available.

In yet another embodiment of the second conveying and mixing tube, a supply funnel is provided in the area of the removal opening of the first conveying and mixing tube. It receives the mixed moist mortar exiting from the first conveying and mixing tube. This provides a technically very simple design for supplying the pre-mixed moist mortar for further processing within the second conveying and mixing tube. Especially, it is not required to provide a special connection, for example, a hose connection between the removal opening of the first conveying and mixing tube and the inlet of the second conveying and mixing tube. Instead, the pre-mixed moist mortar simply falls by the force of gravity into the supply funnel of the second conveying and mixing tube and is then further processed therein.

In another embodiment of the inventive mortar mixing it is suggested that the two conveying and mixing tubes, when not in operation, are to be removed from their respective working position. The basic idea behind and the goal of removability of the two conveying and mixing tubes is that in the non-operative rest position of the mortar mixing machine, especially for transporting the mortar mixing machine, the mixing and conveying tubes do not project from the base (circumferential) contour of the frame so that transporting of the mortar mixing machine is possible without problems, for example, by placing it onto industrial pallets of standard size. The removal of the two conveying and mixing tubes is to be understood in a general sense. For example, the tubes can be physically removed and attached to the underside of the funnel of the hopper or they can be folded, respectively, displaced (slidably retracted). In a special embodiment, the first conveying and mixing tube for reaching the rest position when the mortar mixing machine is to be shut down, is removed from the hopper, for example, by removing a connecting clamp and is fastened for transport below the slanted portion of the funnel of the hopper.

In yet another embodiment of the present invention it is suggested that the second conveying and mixing tube together with the coordinated drive be slidably retractable into the contour fo the mortar mixing machine when it is not in operation. This is a technically simple design for displacing the second conveying and mixing tube for transporting the mortar mixing machine (or when the second tube is not needed during operation) in a telescoping manner into a position underneath the hopper. In this position the second conveying and mixing tube does not project from the circumferential contour of the hopper, respectively, of the frame. The first conveying and mixing tube, as already mentioned, is preferably demounted from the hopper and is fastened below the hopper at the slanted portion of the hopper funnel.

In yet another embodiment of the present invention, the second conveying and mixing tube is positioned within the circumferential contour of the mortar mixing machine when retracted. This has the advantage that, for example, for the transport of the silo (hopper), the standard size of industrial pallets can be complied with in a simple manner. During transport there are thus no projecting portions and the mortar mixing machine can be transported in its entirety, i.e., with all individual components attached, like a regular silo (hopper) to the desired location. The special advantage of the invention is the compact design of the mortar mixing machine as well as the simplicity of its transport.

Finally, in another embodiment with respect to the displaceability of the second conveying and mixing tube, it is suggested to provide a carriage with rollers (wheels). Thus, the entire unit, including the second conveying and mixing tube and the drive, can be mounted onto a drawer-type arrangement. At the work location the drawer-type arrangement is then simply pulled out together with all required components and the tube is immediately operable. Of course, in the retracted as well as in the extended position the unit is secured with respective fastening means known to a person skilled in the art.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
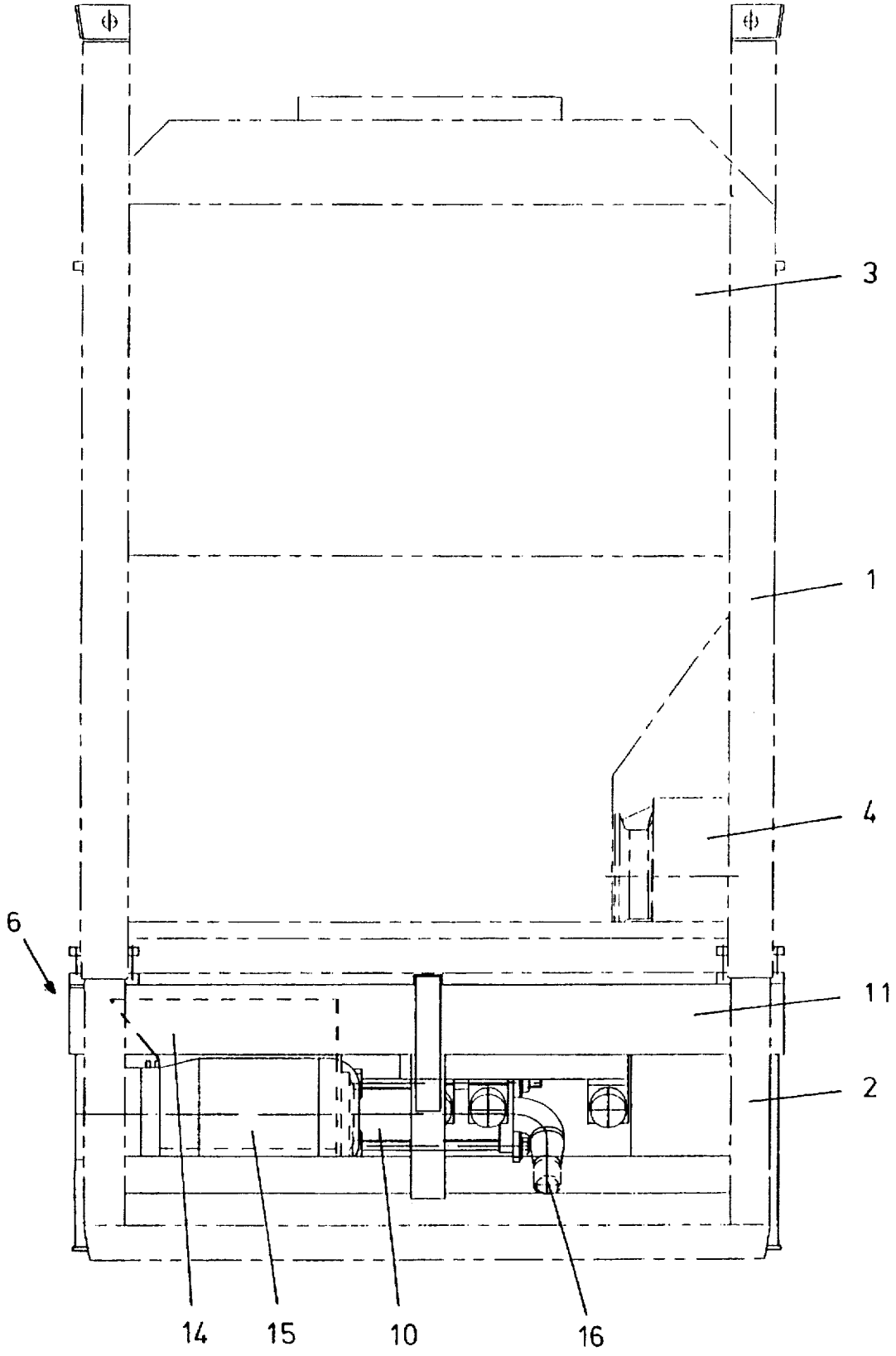
FIG. 1 is a side view of the inventive mortar mixing device.
Figure 2:
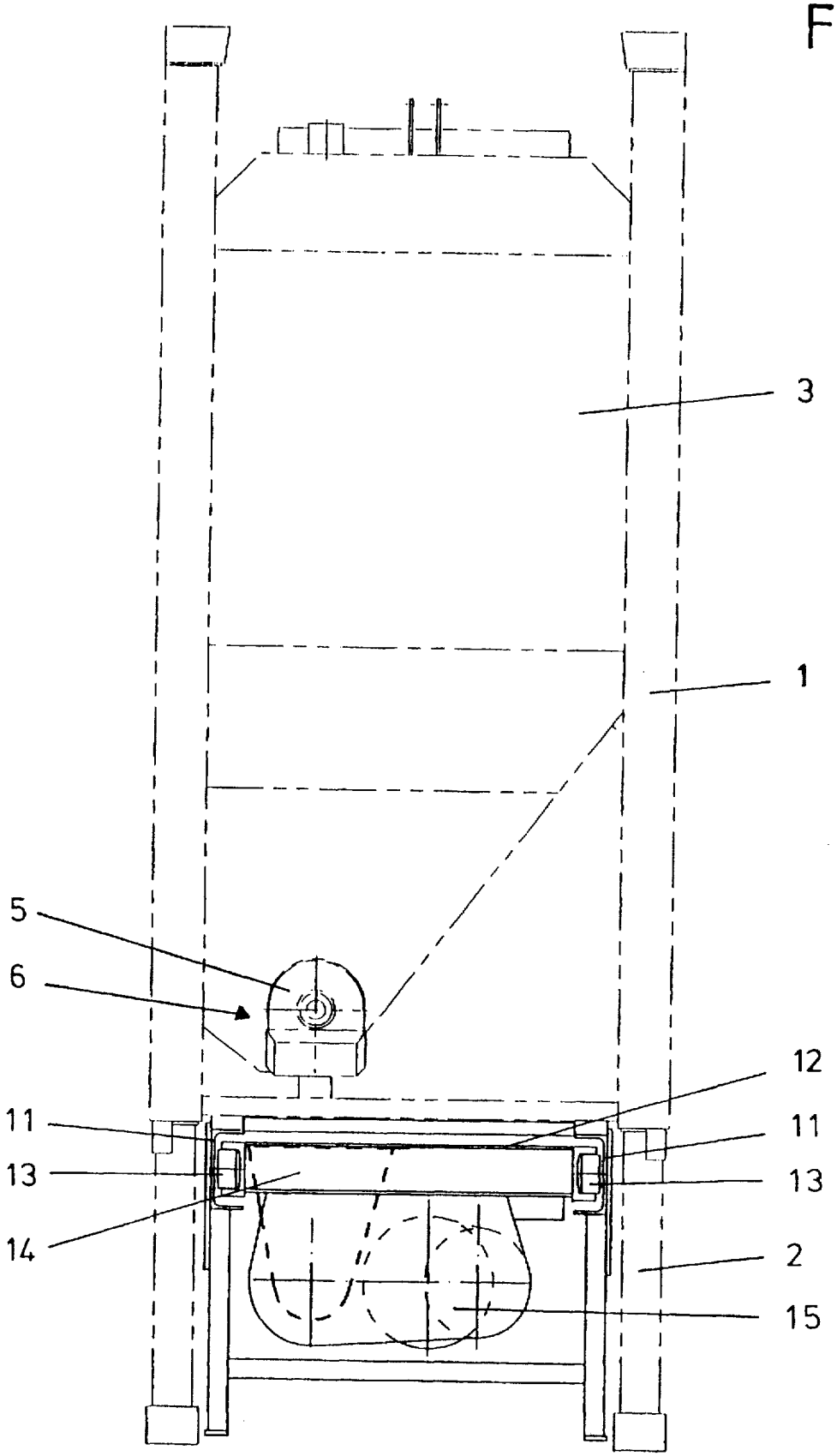
FIG. 2 is an end view of the mortar mixing device of FIG. 1.
Figure 3:
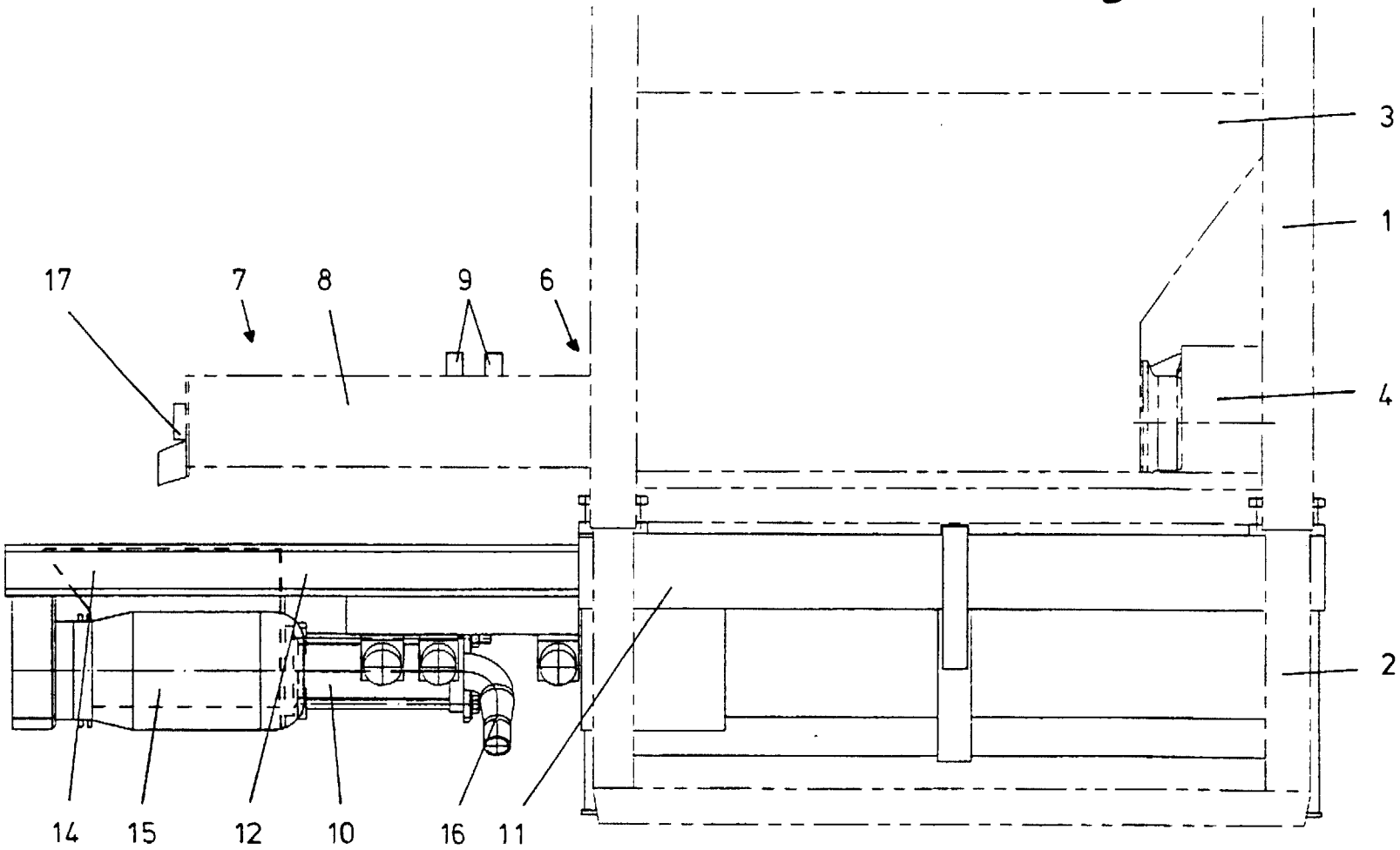
FIG. 3 is a detail of the mortar mixing device of FIG. 1 in its operating position with attached first mixing and conveying tube and extended second conveying and mixing tube.

The present invention will now be described in detail with the aid of several specific embodiments utilizing FIGS. 1 through 3.

The mortar mixing machine comprises a parallelepipedal frame 1 of a standard European pallet size (80×120 cm) and can be stacked. This frame I is provided with legs 2 that can be extended to different heights. Accordingly, any conventional mortar pump and other containers of different size can be connected to the frame. Within the frame 1 a hopper 3 with a funnel-shaped bottom is provided which tapers in the downward direction conically as is, for example, visible in the representation of FIG. 2. The two slanted walls have different slant angles. The downward movement of the dry mortar, which is contained within the hopper 3, is thus ensured at any time. This container (hopper) 3 serves simultaneously as a transport container for the dry mortar to the location of use.

In the bottom area of the hopper 3 a non-represented conveying device with a worm conveyor is provided. This conveying device is driven by an electric motor 4 which in the axial direction of the worm conveyor is positioned below the funnel slant of the container 3 and is thus positioned within the circumferential contour of the frame 1. The worm conveyor opens into a non-represented metering tube with a metering worm gear downstream of an outlet opening 5 of an outlet 6 of the hopper 3.

External to the hopper 3 a mixing unit 7 with a conveying and mixing tube 8 is connected to the outlet opening 5 and comprises a mixing worm gear. The conveying and mixing tube 8 is furthermore provided with two water inlets 9. The corresponding water connecting lines are not represented.

Below the conveying and mixing tube 8 a second conveying and mixing tube 10 is provided. This second conveying and mixing tube 10 is connected to the frame 1 below the hopper 3 so as to be retractable and extendable. For this purpose, the frame 1 has connected thereto guide rails 11 and the conveying and mixing tube 10 comprises a carriage 12 with rollers 13. The exterior end of the conveying and mixing tube 10 is provided with a supply funnel 14 and also with a laterally arranged electric motor 15 for driving the spiral pump positioned within the conveying and mixing tube 10. The proximal end of the conveying and mixing tube 10 also comprises a pressure flange 16 for connecting the tube 10 to a mortar conveying line. As can be seen in FIG. 3, the two conveying and mixing tubes 8, 10 extend horizontally and are thus parallel to one another.

The thus embodied mortar mixing machine functions as follows.

In the non-operative position of the mortar mixing machine the mixing unit 7 with conveying and mixing tube 8 and the mixing shaft positioned therein is fastened below the slant of the hopper funnel. This mixing unit 7 with its components is thus positioned within the contour of the mortar mixing machine, respectively, its frame, having dimensions matching the standard European pallet size. This holds also true for the second conveying and mixing tube 10 which is displaced with its carriage 12 into a position below the hopper 3 and secured in this position as shown in FIG. 1. All components of the tube 10, including the electric motor 15, are thus positioned within the contour of the mortar mixing machine. The two mixing units thus do not present any projections during transport. Furthermore, an optimal space and weight loading of the transport vehicle is ensured. With a low center of gravity there is no need for additional securing devices during transporting.

After filling the container 3 with dry mortar, the entire mortar mixing machine, after transport onto the work location, is readied for operation. For this purpose, the mixing unit 7 with conveying and mixing tube 8 is connected to the outlet opening 5 of the hopper 3, for example, with the aid of a connecting clamp. By doing so, the mixer shaft with worm conveyor is also coupled to the hopper 3. Additionally, the water supply line is connected to the water inlets 9. Furthermore, the second mixing unit with conveying and mixing tube 10 is telescopically extended with its carriage 12, designed in the manner of a drawer, from the frame 1 into its working position. This situation is represented in FIG. 3. In this working position, the removal opening 17 of the upper conveying and mixing tube 8 is positioned above the supply funnel 14 of the lower mixing and conveying tube 10.

For operating the mortar mixing machine, the electric motor 4 drives the worm conveyor within the hopper 3. The spiral pump of the conveying and mixing tube is rotated with the electric motor. The dry mortar is thus fed within the hopper 3 by the conveyor to the metering worm gear. This metering worm gear transports a constant amount of dry mortar into the conveying and mixing tube 8 of the mixing unit 7 flanged to the hopper 3. With an installed water metering system the required amount of water is introduced into the conveying and mixing tube 8 via the water inlets 9. The mixing shaft positioned within the tube 8 mixes the mixture of dry mortar and water which is then removed from the tube 8 via the removal opening 17 at the forward end. The mixed moist mortar falls into the supply funnel 14 of the second conveying and mixing tube 10 and is then conveyed with the spiral pump, driven by the electric motor 15, to the pressure flange 16. Along this path further mixing takes place. Within the second conveying and mixing tube 10, which is arranged horizontally parallel to the first conveying and mixing tube 8, the moist mortar is thus transported in a opposite direction to the conveying direction within the conveying and mixing tube 8. By arranging the second conveying and mixing tube 10 downstream of the conveying and mixing tube 8, the premixed moist mortar is thus subjected to a longer and more intensive mixing effected by the mixing tools so that, in general, the mixing quality of the moist mortar is improved. The second conveying and mixing tube 10 is provided with an rpm controlled conveyor pump and serves simultaneously to move the finish-mixed moist mortar to the final destination where it is to be applied in the correct amount.

The present invention is, of course, in no way restricted to the specific disclosure of the specification and drawings, but also encompasses any modifications within the scope of the appended claims.

What we claim is:

1. A mortar mixing machine comprising:

a frame;

a hopper, supported by said frame, for containing dry mortar;

said hopper having an outlet with an outlet opening;

a first conveying and mixing tube, connected in a working position thereof to said outlet so as to extend horizontally and having at least one water inlet, for mixing the dry mortar fed into said conveying and mixing tube from said hopper with water introduced via said at least one water inlet to prepare mixed moist mortar;

said first conveying and mixing tube having a removal opening for the mixed moist mortar remote from said outlet;

a second conveying and mixing tube connected to said frame for directly receiving in a working position thereof the mixed moist mortar;

said second conveying and mixing tube conveying the mixed moist mortar in a direction opposite to the conveying direction of said first conveying and mixing tube;

wherein said first and said second conveying and mixing tubes are removable from said working positions into a respective rest position; and wherein said second conveying and mixing tube comprises a drive and is slidably retractable into said rest position together with said drive.

2. A mortar mixing machine according to claim 1, wherein said second conveying and mixing tube extends horizontally.

3. A mortar mixing machine according to claim 2, wherein said second conveying and mixing tube is separate from said first conveying and mixing tube and said drive effects conveying and mixing.

4. A mortar mixing machine according to claim 3, wherein said second conveying and mixing tube is positioned below said first conveying and mixing tube.

5. A mortar mixing machine according to claim 4, wherein said second conveying and mixing tube comprises a supply funnel positioned below said removal opening of said first conveying and mixing tube.

6. A mortar mixing machine according to claim 1, wherein said second conveying and mixing tube in said rest position is positioned within a circumferential contour of said frame.

7. A mortar mixing machine according to claim 1, wherein said second conveying and mixing tube comprises a carriage and wheels for retracting said second conveying and mixing tube into said rest position.

* * * * *